US005885444A

United States Patent [19]

Wansbrough et al.

[11] Patent Number: 5,885,444

[45] Date of Patent: Mar. 23, 1999

[54] PROCESS FOR CONVERTING WASTE MOTOR OIL TO DIESEL FUEL

[75] Inventors: Robert W. Wansbrough; Calvin E. Moore, Jr., both of Houston, Tex.; William D. Carraway, Pawleys Island, S.C.

[73] Assignee: Green Oasis Environmental, Inc., Charleston, S.C.

[21] Appl. No.: 809,000

[22] Filed: Mar. 3, 1997

Related U.S. Application Data

[63] Continuation of Ser. No. 530,069, Sep. 19, 1995, abandoned, which is a continuation of Ser. No. 248,738, May 25, 1994, abandoned, which is a continuation-in-part of Ser. No. 977,627, Nov. 17, 1992, abandoned.

[51] Int. Cl.[6] ..... C10M 175/02; C10G 9/14

[52] U.S. Cl. ..... 208/179; 208/67; 208/100; 208/131; 208/184; 208/106

[58] Field of Search ..... 208/184, 67, 179, 208/97, 100, 131, 106

[56] References Cited

U.S. PATENT DOCUMENTS

| | | | |
|---|---|---|---|
| 1,546,055 | 7/1925 | Wilson et al. . | |
| 3,717,569 | 2/1973 | McAllister et al. . | |
| 3,923,643 | 12/1975 | Lewis et al. . | |
| 3,954,602 | 5/1976 | Troesch et al. . | |
| 4,033,859 | 7/1977 | Davidson et al. . | |
| 4,071,438 | 1/1978 | O'Blasny . | |
| 4,101,414 | 7/1978 | Kim et al. . | |
| 4,190,520 | 2/1980 | Gewartowski | 208/95 |
| 4,233,140 | 11/1980 | Antonelli et al. . | |
| 4,292,140 | 9/1981 | Kawasaki et al. | 203/22 |
| 4,381,992 | 5/1983 | Wood et al. . | |
| 4,512,878 | 4/1985 | Reid et al. . | |
| 4,666,587 | 5/1987 | Martin | 208/184 |
| 5,049,258 | 9/1991 | Keim et al. | 208/184 |
| 5,143,597 | 9/1992 | Sparks et al. . | |
| 5,248,410 | 9/1993 | Clausen et al. . | |
| 5,271,808 | 12/1993 | Shurtleff | 196/46 |
| 5,316,743 | 5/1994 | LeBlanc et al. | 422/256 |

FOREIGN PATENT DOCUMENTS

| | | |
|---|---|---|
| 0360500 | 3/1990 | European Pat. Off. . |
| 187092 | 6/1979 | New Zealand . |
| 184277 | 8/1980 | New Zealand . |
| 9098426 | 8/1990 | WIPO . |
| 9411471 | 5/1994 | WIPO . |

OTHER PUBLICATIONS

Speight, James G., *The Chemistry and Technology of Petroleum,* Marcel Dekker Inc. New York (1990), pp. 529–544.

*Primary Examiner*—Bekir L Yildirim
*Attorney, Agent, or Firm*—Oliff & Berridge, PLC

[57] ABSTRACT

A process for thermally cracking waste motor oil into a diesel fuel product is provided. The thermal cracking process uses low temperature cracking temperatures from 625° F. to 725° F. with ambient pressure to generate a column distilled fraction of diesel fuel mixed with light ends, the light ends being flashed off to produce a high quality #2 diesel fuel. The process further provides for removal from the cracking vessel an additional product stream which, when filtered, is suitable for use as a #3 fuel oil and that can be further blended with a bunker oil to yield a #5 fuel product.

16 Claims, 4 Drawing Sheets

PROCESS FOR CONVERTING WASTE MOTOR OIL TO DIESEL FUEL

RELATED APPLICATIONS

This application is a continuation of application Ser. No. 08/530,069, filed Sep. 19, 1995, now abandoned, which in turn is a continuation of application Ser. No. 08/248,738 filed May 25, 1994, now abandoned, which in turn is a continuation-in-part of application No. 07/977,627 filed Nov. 17, 1992, now abandoned.

BACKGROUND OF THE INVENTION

This invention is directed towards the art of converting used motor oil to a useable fuel source.

Currently, the market for used motor oil has stymied many recycling and reclamation efforts. The market for used motor oil has largely been geared to limited processing steps which convert the used motor oil into a low quality fuel such as bunker oil (#6 fuel oil). Alternatively, a limited amount of used motor oil is reclaimed and converted into a recycled motor oil product.

Used motor oil retains a high energy potential. However, hazards and cost associated with collecting, storing, transporting, and general handling of used motor oil has limited the efforts to collect used motor oil for disposal or recycling. Although the prior art provides limited processing of used motor oil for other petroleum products, there remains a need for improvement within the art of converting used motor oil to a high quality energy source.

OBJECTS OF THE INVENTION

It is thus an object of this invention to provide a process for converting used motor oil into a diesel fuel product.

It is a further object of this invention to provide an apparatus and process for the low temperature, ambient pressure cracking of used motor oil into a diesel product.

It is yet another object of this invention to provide for mobile equipment which can be used for processing used motor oil to a diesel fuel product.

It is yet another object of this invention to provide for a process where the conversion of used motor oil to a diesel fuel product which compiles with environmental regulations.

These, as well as other objects of this invention, are provided by a process including: [providing a cracking apparatus, the apparatus comprising a cracking vessel, the vessel in communication with a heating means for heating the used oil, a distillation column in communication with the vessel, and a condenser in communication with the distillation column; supplying the cracking vessel with a source of used motor oil; heating the used motor oil to a cracking temperature; cracking the used motor oil to a mixture of lighter molecular weight compounds; separating the lighter molecular weight compounds into a first mixture of a small fraction of volatile light ends and a second mixture of diesel fuel; collecting the second mixture of diesel fuel.]

DETAILED DESCRIPTION

Process

In accordance with this invention, it has been found that waste oil from internal combustion engines can be cracked under low temperature, low severity conditions to yield #2 grade diesel fuel and a #3 fuel which can be further blended into a #5 fuel. This process occurs at much lower temperatures than was conventionally thought to be possible and permits the continuous flow processing of waste oil to a #2 grade diesel fuel without coking or fouling of the cracking apparatus.

Figure 1:
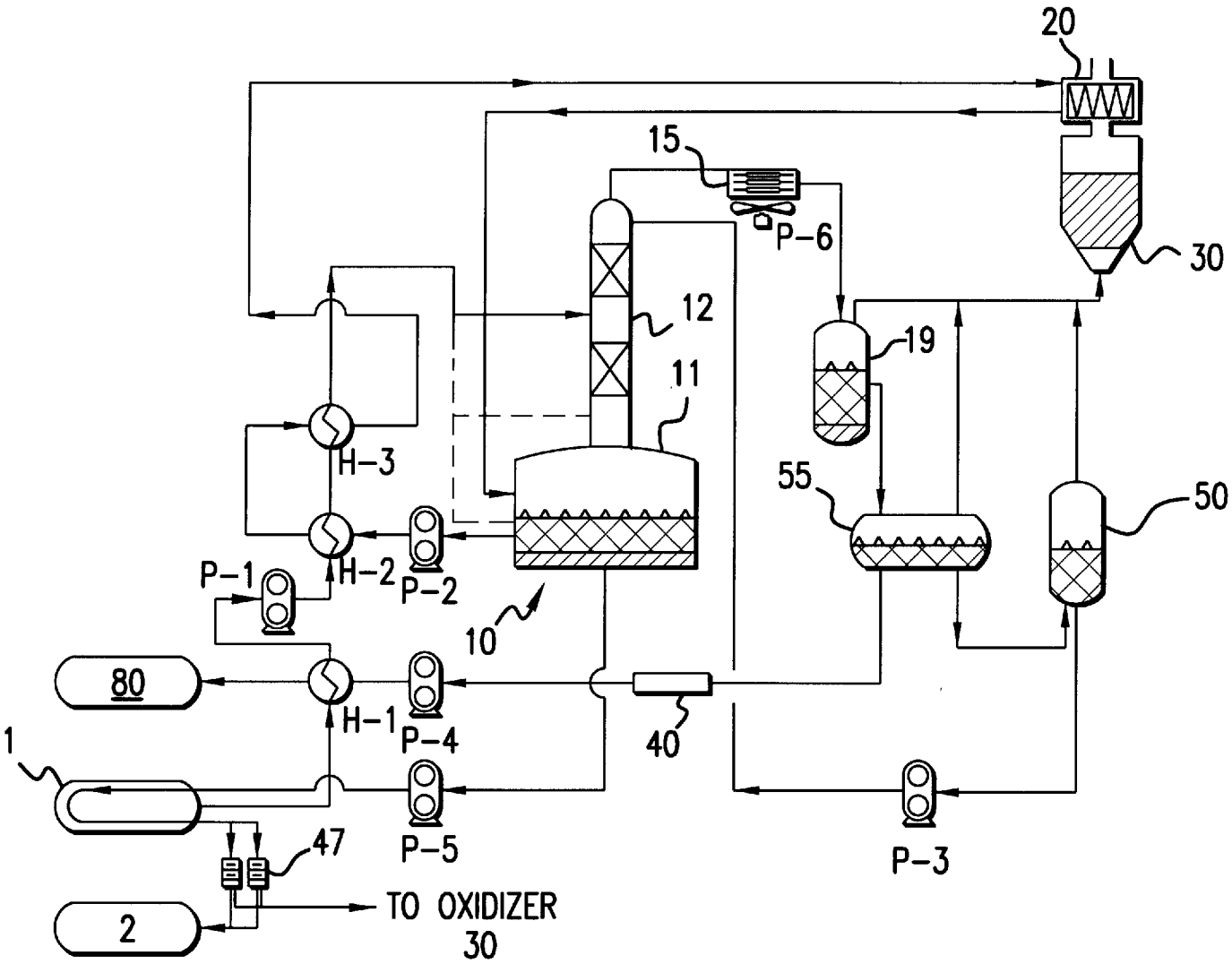
FIG. 1 is a schematic of the process and apparatus envisioned to carry out the process.

The system and its operation is schematically shown in the process flow diagram of FIG. 1.

Used oil feedstock is stored in holding tank 1. The used motor oil feedstock contains a mixture of parafins, napthenes, aromatics, and olefins with 30% of this waste oil already within a molecular weight range for a diesel product. The process and system accepts entrained water contents of 2%–5% and has been tested with used oil feedstocks having a water content as high as 7%. However, entrained water will be converted to vapor in this system, with consequent absorption of heat. This will somewhat reduce the efficiency of the thermal oxidizer 30 to be described later, requiring more supplemental fuel input to the system to maintain process temperatures and reduce the final product yield accordingly. Finally, metal particles and shavings from engine wear are usually suspended in the waste oil. These metal particles are typically in the micron and submicron range and are sufficiently small such that they pass through standard oil filters. One skilled in the art would have thought that these metal particles would have been detrimental to the cracking employed in the instant process because the particles would have raised the temperature needed for thermal cracking, thereby increasing the energy costs associated with the cracking process. Accordingly, one skilled in the art probably would have been of the opinion that it would not have been possible to efficiently and economically crack waste motor oil containing metal particles. However, as the results shown herein indicates Applicants have found that that is not the case.

The used oil feedstock is pre-heated first, while in the holding tank 1 by the #3 product stream on its way to a storage tank 2 and then, in a series of three heat exchangers (H-1, H-2, H-3), until it reaches a temperature of about 500° F. before entering the reaction and distillation assembly 10. By exchanging heat, especially from the exiting #3 stream to the used oil feedstock stream, the overall energy requirements of the system is greatly reduced. Finally, pump P-1 controls the rate of feed into the system of the used oil feedstock.

The pre-heated used oil feedstock is fed to a reaction and distillation 10 assembly comprising a cracking vessel (still pot) 11 and a distillation column 12. The cracking vessel 11 can vary in size and volume. The cracking vessel 11 typically has an operating or cracking temperature of between about 625°–700° F. which is maintained by a heat recovery unit 20 which is preferably powered by a thermal oxidizer 30. Although the cracking temperature can be raised to give a higher cracking rate, this would also increase the light end production. However, that is just the opposite of the desired result. The key to the present invention is to operate at as low a cracking temperature as possible to minimize light end production and avoid coking problems. While it is difficult to analyze cracking reactions, it has been found that it is possible to carry out the thermal cracking such that only a small percentage of light ends are being produced relative to #2 diesel fuel product. Therefore, it is inferred that under the mild conditions employed, cracking products which constitute #2 diesel fuel product can be economically obtained. A portion of the waste oil is extracted from the vessel 11 by pump P-2 and circulated through a recirculating loop containing heat recovery unit 20 and which heats the extracted oil to 700° F. producing a mixed vapor/liquid product which is then returned to the vessel 11 to maintain the vessel 11 at the proper process temperature.

The distillation column 12 is an insulated cylinder 14 feet in height with interior diameters of 10, 18, or 24 inches depending upon the model. The column 12 is filled with standard packing material known as nutter rings. Exotic column packing materials or any type of catalyst based cracking systems would be quickly poisoned by the diverse metals and other compounds found in waste oil and, therefore, are not preferred.

With proper temperature control, all of the lower molecular weight material fractions whose boiling point is that of #2 diesel or less, e.g., #2 diesel, light ends, (which may include up to 200 separate components) and volatile products leave the top of the column 12 as vapors. Gases leaving the top of the column 12 pass through an air-cooled tube-type condenser 15, where the temperature is reduced by approximately 350° F. to a temperature of around 250° F., collecting mostly as liquid in the light ends flash vessel 19.

It has been found that coke formation, a common problem in petroleum cracking, is not occurring on the cracking equipment used in the present process. While coke formation is a poorly understood phenomena, it is believed that the low temperatures employed to crack the waste oil are sufficiently mild that coking is avoided. Further, removal of the #3 fuel stream from the cracking vessel is believed to be beneficial in preventing the formation of coke.

It may also be that any coke formation which may be occurring, is being selectively deposited upon the suspended metal particles. If so, then the metal/coke particles are removed as part of the #3 fuel stream withdrawal process. This slurry can be used following filtration as a #3 fuel oil source. In addition, the #3 fuel oil can be blended with a bunker oil to produce a #5 fuel oil.

Both the #2 diesel fuel stream and the #3 fuel oil stream can use a stainless steel ultra filtration apparatus from DuPont Separation Systems, Inc., Seneca, S.C., which consist of a series of increasingly fine matrices to trap particles of smaller and smaller size as the fuel streams are withdrawn. Each of the respective fuel outlet streams has two pump and filter assemblies arranged in series for a total of four filtering apparatuses. The duplex or in series positioning of the filter units enables the continuous flow of the fuel streams even during maintenance and replacement of a single filter unit. The filter placement described above has been found to remove 99.90% of the particles present in untreated used oil, the bulk of the particles being between 1 to 2.5 microns in size.

It has been found that after approximately 50,000 gallons of product has been passed through the filter assemblies, the filter units should be given routine maintenance. Ideally, the filtration media is removed from the filter housing, the media and entrapped particles dried to a powder with the resulting gases added to the fuel input of the oxidizer while substantially removing all the volatile organic compounds present in the gases. Once dried, the media and entrapped particles can be disposed of, as verified by TCLP test results showing that the heavy metals are well below the maximum allowed for solid disposal.

If desired, additional filtration can be provided by a granular alumina silicate available from Pure-Flow Product Group, Newman, Ga., which is widely used in the industry to cleanse petroleum products.

The flash vessel 19 is fitted with two electric band heaters (not shown) and will lower the flash point of the product and flash off the light ends including a light naphtha product and any water vapor. The light ends and light naphtha product are then used as fuel input to the thermal oxidizer 30. Alternatively, the #2 diesel fuel can be reheated and passed through another flash pot or a vapor separator where the more volatile light ends are separated and collected. The remaining liquid, #2 diesel fuel, is transferred to the product tank 55. From there, the #2 diesel fuel leaves as the final product with some condensed liquids going to a reflux drum 50 and used to keep the temperature at the top of distillation column 12 somewhat cooler than that of the vessel 11. The rate of reflux, from the reflux drum 50 to the column 12, is controlled by pump P-3. This rate is quite important. The vapor liquid contact between reflux and hot vapors helps the cracking reaction proceed. The reflux is fed into the distillation column 12 at a location 18 inches below the top of the column. A distribution plate (not shown) which is present in the column helps distribute the reflux evenly over the column. However, since the reflux requires energy to bring the reflux back up to temperature, the goal is to provide only sufficient reflux to maximize the desired products. Excessive amount of reflux lowers the profits of the overall operating system. A reflux ratio of 0.7–1:1 has been found useful in the above process.

As an example, extremes of a simulation study using kerosene range from a reflux ratio of 3.9 which required a BTU input of (1,199,970) one million, one hundred and ninety nine thousand, nine hundred and seventy BTUs per hour which gave a projected product ratio of 8,5743 of number 2 diesel fuel/16.5817 number 3 diesel fuel. When the reflux ratio is raised to 7.6, the BTU requirement is (4,146,830) four million, one hundred forty six thousand, eight hundred and thirty BTUs per hour giving a product ratio of 13.8681 for number 2 diesel fuel/7.6403 to number 3 fuel oil. The simulation figures above, while based upon a kerosene product, demonstrate that the reflux rate can drastically effect not only the energy input requirements in the cracking process, but can affect the overall ratio of the diesel fuel product to the heavier fuel oil product.

Heavier components such as polymer oil, other cracking products with higher boiling points and solid wastes collect in the bottom of vessel 11 and are removed and sent through a filtration system 47 to remove residue, water and metal particles by pump P-5 as #3 fuel product. It has been found that a twenty five percent withdrawal for the #3 fuel product in relation to the amount of introduced feed stock is desirable. At this level of withdrawal, the overall energy input requirements and production rates for the #2 diesel fuel products are achieved in an economical fashion. However, the withdrawal rate could be raised or lowered depending on variables in feed stock quality as well as the desired quantities of the various fuel streams. The #3 fuel product can be used directly as a fuel oil or can be blended with #6 bunker fuel to produce a marketable #5 fuel. The #3 stream is pumped through a filtration system 47 under pressure to remove residue, water and metal particles.

The thermal oxidizer 30 takes the place of the usual reboiler. As described above, the recirculation loop between vessel 11 and heat recovery unit 20 includes two (H2, H3) of the three heat exchangers present. Accordingly, heat from the recirculation loop also pre-heats the used oil feedstock, the other heat exchanger H-1, exchanges heat from the #2 diesel final product line to the incoming used oil feedstock. The rate of recirculation through this recirculation loop is controlled by pump P-2 and the amount of heat added is a function of the fuel air flow rate to the thermal oxidizer 30.

Figure 2:
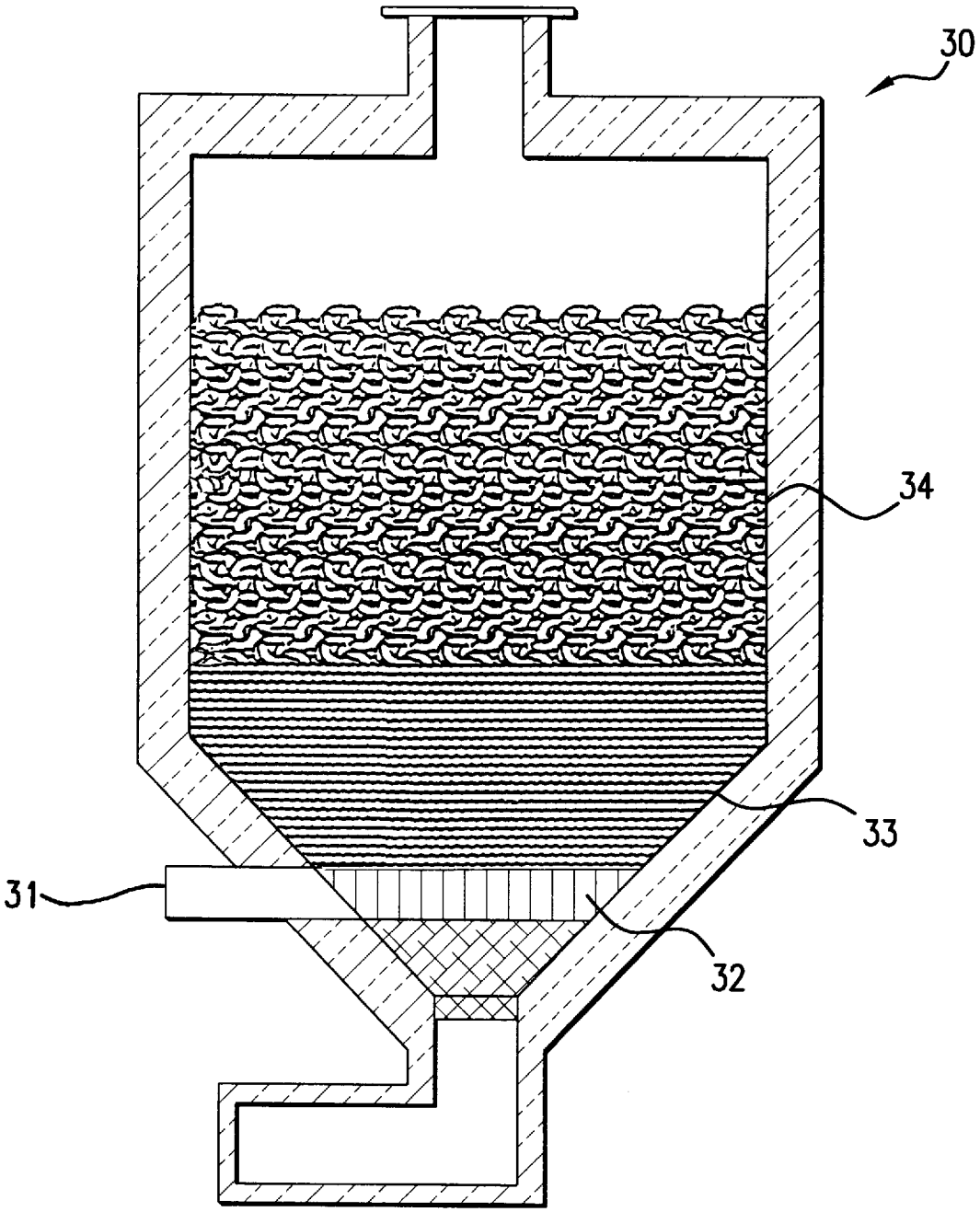
FIG. 2 is a sectional view of a thermal oxidizer in accordance with this invention.

The thermal oxidizer 30 is manufactured by Green Oasis under license from its designer, Thermatrix, Inc., of San Jose, Calif. and is shown schematically in FIG. 2. The fuel/air mixture, containing the light ends and some reflux, enters the unit at the inlet point 31 and then passes through the distribution plenum 32, where it is evenly directed into a two part 33, 34 inert ceramic matrix above. Any vapors from product tank 55 or reflux drum 50 are added to the light ends burned off in flash vessel 19 as fuel input to the thermal oxidizer 30. The first zone 33 of the matrix provides thorough mixing of oxygen and fuel.

The reaction zone 34 is pre-heated at start-up, and operates at temperatures on the order of about 1,600° F. As the vapor mixture passes into the reaction zone 34, the vapor mixture heats up to its oxidation temperature, where it completely oxidizes. Because the geometry of the inert ceramic matrix 33, 34 inhibits flame propagation, oxidation and release of heat occur in a flameless process.

The heat produced by the oxidizer is used to raise the temperature of the pre-heated feedstock to its final reaction temperature of 625°–700° F. through the heat recovery unit 20. While a slight inherent pressure may exist at the bottom of column 12 by the cracking reactions, this is still within what one skilled in the art would call atmospheric distillation.

Thermal oxidizer technology offers a number of important state of the art technological advantages as well as environmental and regulatory advantages. For example, the oxidation process converts hydrocarbons to water and carbon dioxide with a destruction/removal efficiency (DRE) of at least 99.99%. By contrast, other systems have 99% DRE. This 0.99% difference represents a release of 100 times more volatile organic compounds (VOC's) into the atmosphere. Depending upon applicable law, the levels of efficiency achieved with flameless operation may exempt the system from boiler permit requirements and may qualify it for minor source exemptions. Furthermore, another advantage of the thermal oxidizer 30 is the near-100% oxidation of input fuels. This increases the amount of heat available for use in the process, reducing the amount of required fuel supplement and improving final product yield. The thermal oxidizer is also much safer than prior art alternatives. It is flameless, with anti-flashback protection, and operates below the lower explosive limit (LEL), qualifying the system for operation in hazardous areas. The thermal oxidation process is also far more easily controlled than a flame-based boiler because it may be operated over a wider range of fuel rates and is more tolerant of minor variations in fuel rates during operation.

Finally, before the #2 diesel enters storage tank 80, chemical additives from a source 40 may be added to stabilize the #2 diesel product by preventing the formation of reactive molecules such as diolefines which can add an objectionable color to the #2 diesel product. Furthermore, #2 diesel fuel product will often darken over time due to the presence of reactive olefins within the fuel. To prevent this discoloration, well known fuel stabilizers such as Stabil-AD 5300 oil additive, produced by Malco Chemical Company of Naperville, Ill., have been found to stabilize the olefins when added according to the manufacturers directions to the #2 product.

The thermal cracking process described produces a #2 diesel fuel suitable for non-highway use. Further, the process is compatible with a wide range of waste oil feed stock. While highly uniform feed stock sources, such as those from an oil recovery system for fleet vehicles, are ideal for processing, there is a vast supply of used motor oil which varies as to content and source. For example, specialty lube shops and service stations represent a feed stock source of extreme variation in oil types in terms of viscosity, gas/diesel ratings, anti-oxidant content, detergent additives and the presence of synthetic oils. Further, community collection sites for used oil often contained other petroleum products such as greases, gear oils and other types of lubricating oils.

In accordance with this invention, it has been found that the present process is fully compatible with a wide and diverse range of waste oil starting material. The preferred process uses a pump to periodically inject preheated waste oil into the cracking vessel. Likewise, an additional pump is used to periodically withdraw materials from the bottom of the cracking vessel. As a result, of the near continuous flow of material into and from cracking vessel, there is constant variation in the makeup of the material which is contained in the cracking vessel.

Preferably, the cracking process is carried out at a preselected temperature and reflux rate. It has been observed that at any one instance, the collected product from the distillation column may not meet the specifications for the #2 diesel fuel. However, such short term fluctuations are transient and the aggregate distillation product will meet the requirements for #2 diesel fuel.

The process and equipment described above are able to be carried within and are supported by a conventional tractor trailer compartment which assist in the initial shipping of the equipment to an appropriate recycling site. The ability to provide a cracking process and equipment that can be supported and housed by a relatively small structure offers an advantage in that processing sites can be easily erected at numerous waste oil collection facilities. Prior art petroleum cracking processes and apparatus have been of such a large scale and size that enormous capital expenditures are required for conventional petroleum cracking facilities. Such facilities require transport of the material to be cracked to the processing site. The much smaller scale of the applicant's process and applicant's ability to process waste oil directly into a diesel fuel product enables numerous processing sites to be set up locally, avoiding the need for the handling and transport of large quantities of waste oil to one central processing facility.

EXAMPLE ONE

During late 1993 and early 1994, a series of operational tests and material balance analyses were conducted using a test unit installed at applicant's facilities.

As indicated in Table 1A, the diesel product (GOE #2) has a sufficiently high flash point, cetane rating, and distillation profile to meet federal standards for #2 diesel fuel. Test summaries and compilation of data results are summarized in Table 1A along with fuel grade industry standards. It should be noted that the figures set forth for the standard fuel products are minimum standards and minimum ranges to be classified as the respective grade of fuel oil. In many instances, the diesel product produced, GOE #2 and GOE #3 will surpass the standards and requirements for the standard fuel oil grades as are followed by the industry.

It should be noted that the normal sulfur content is below the 1993 EPA standard of 0.5% but above the new (1994) standard of 0.05% for "over-the-road" fuel use. The #2 diesel fuel is therefore dyed dark blue, as required by law, to identify off-road fuels sold for agricultural, marine and industrial applications, as to which the new standard does not apply. It is believed that an additional additive or treatment may be possible that will bind the sulfur molecules to create larger particles. These larger molecules could then be removed in the filtration system, bringing sulfur content below the more restrictive limit and permitting on-road use. Note: As seen in Table 1B, there is a natural volumetric expansion during processing of between 0 and 8%. This is because of the different densities of the starting material, used oil, and the less dense products of #2 and #3 fuels, etc. Further, the above data in Table 1B does not include the volume of diesel fuel products and light ends which were used to generate the heat for the cracking vessel.

Runs of purchased open market waste oil were also made at the following temperatures (all in °F.): 659, 675, 681, 722. In each instance, a marketable #2 diesel fuel product was obtained. In addition, a 12 hour run was conducted with a composite average temperature of 666° F. These runs all produced results similar to the representation data provided above. Set forth in Table 2 is an analysis of the product collected at two points along the product run as well as a batch composition of the final product. The above results leads applicant to believe that the process can be carried out across a wide range of temperatures, including temperatures, lower or higher than those set out above, yet still produce high quality #2 diesel fuel.

In carrying out the above process, it has been found desirable to select an initial cracking temperature for the cracking vessel and to maintain that temperature over a prolonged time period. To accomplish this, applicant's preferred process uses a programmable logic controller provided by a Siemens/Texas Instruments 545 controller in conjunction with Interact software produced by Computer Technology Corporation, Charleston, S.C. It is well within the ordinary skill level of one trained in computers and computer software to provide a programmable logic controller and software which is capable of monitoring and automatically adjusting flow rates, temperature and temperature adjustments, pump operations, feed and withdrawal rates, reflux rates, and monitoring sensors which may be desirable on various components of the apparatus used to carry out the above process. As set forth in FIG. 4 and Table 4 the principal sensors and controls are set forth in a schematic fashion indicating a preferred manner of operation of the programmable logic controller.

Figure 3:
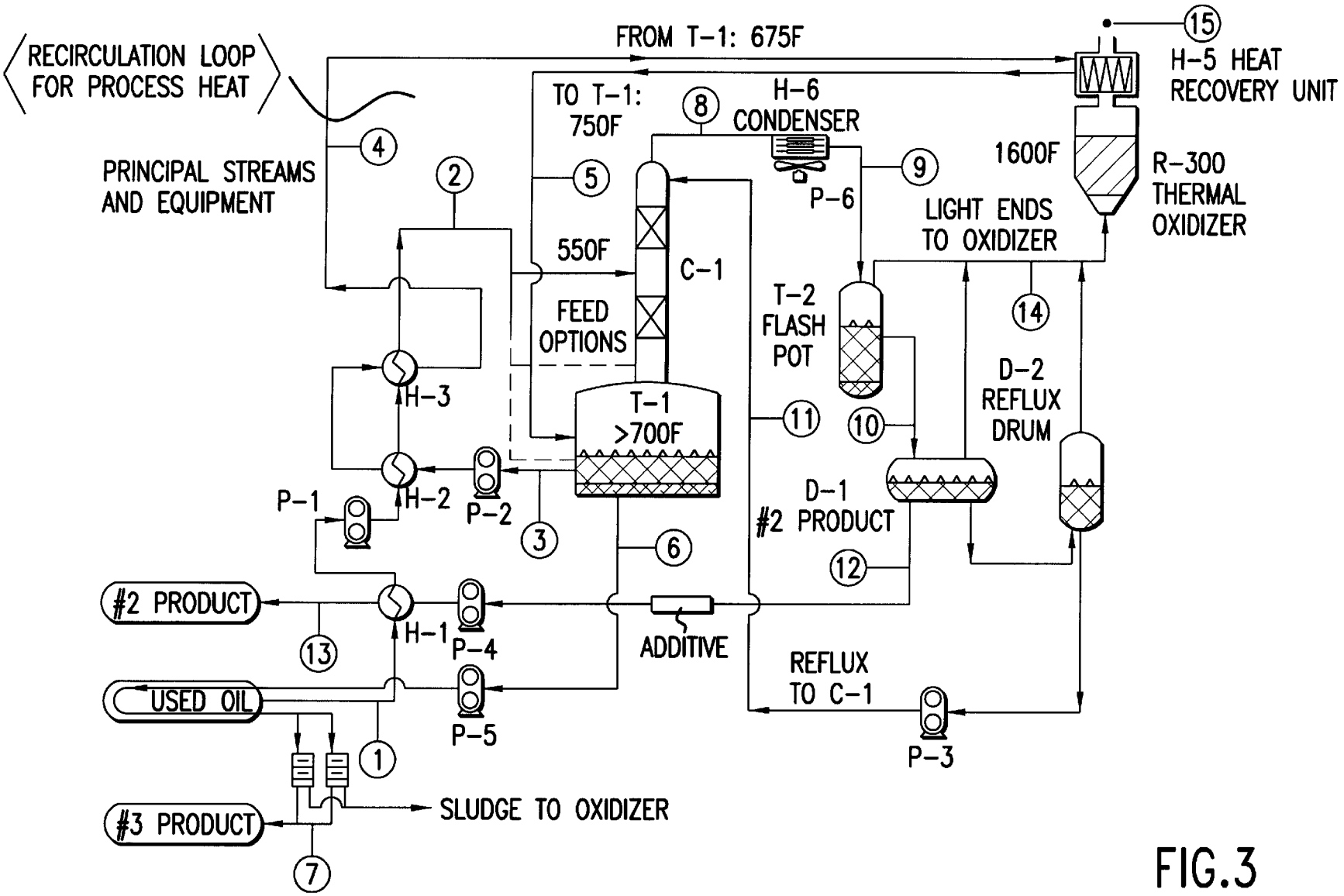
FIG. 3 is an additional schematic of sensor locations and controls with optional flow patterns indicated by dashed lines.
Figure 4:
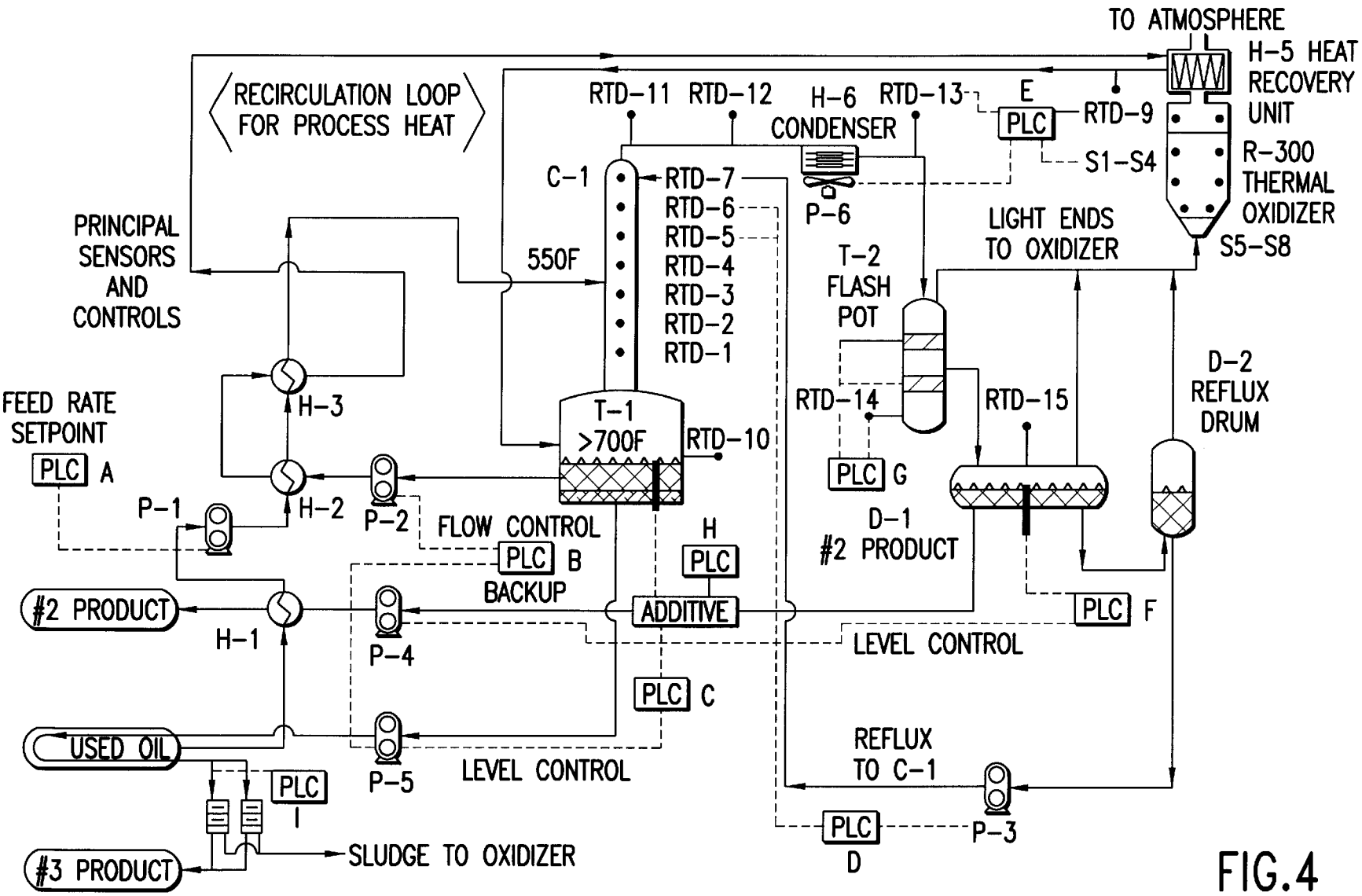
FIG. 4 is an additional schematic of the process showing streams of material flow in conjunction with Table 3.

An additional schematic diagram seen in FIG. 3 illustrates principal streams and equipment useful for carrying out the present invention. As set forth in Table 3, the numbered streams of FIG. 4 are indicated indicating the stream, the phase of the stream, the temperature of the stream, the composition of the stream as well as the flow rate of the stream. The data presented in FIG. 3 and Table 3 is a representative compilation of several test runs. As seen in Table 3, 7.2 gallons per minute of reflux liquid is added to the distillation column for every 10.7 gallons per minute distillate collected off the column. While the reflux ratio can be as low as 0 or as high as 2 to 1, a preferred operating range is believed to be between 0.7 to a 1 to 1 ratio.

It is thus seen that the present process provides for a method of converting used motor oil to a diesel fuel product. As many variations and modifications of the above process will be apparent to those having skill in the art from a reading of the above specification, and, therefore, such variation are within the spirit and scope of the following appended claims.

That which is claimed is:

1. A continuous process for cracking unprocessed waste motor oil into a plurality of fuel oils comprising:

thermally cracking the unprocessed waste motor oil in a cracking vessel to yield a vaporized fraction of cracked hydrocarbons and a liquid fraction comprising a first fuel oil other than diesel;

continuously withdrawing the first fuel oil from the cracking vessel;

continuously withdrawing a portion of liquid remaining in the cracking vessel;

combining the withdrawn portion of the liquid with additional waste motor oil to obtain a combined stream of additional waste motor oil;

supplying the combined stream of additional waste motor oil to a heat recovery device with a circulation pump wherein the combined stream of additional waste motor oil is preheated to at least the cracking temperature;

simultaneously continuously introducing the combined stream of additional preheated waste motor oil into the cracking vessel in an amount to maintain a volume of waste motor oil in the cracking vessel, the combined stream of additional preheated waste motor oil being fed from the heat recovery device to the cracking vessel by the circulation pump;

separating the vaporized fraction of cracked hydrocarbons in a distillation column, subsequently separating light ends from the vaporized fraction, and collecting a remaining portion of the vaporized fraction, the remaining portion comprising a diesel fuel;

and maintaining the cracking temperature in the cracking vessel by the continuous introduction into the cracking vessel of the additional preheated waste motor oil preheated to at least the cracking temperatures, wherein in the process, the heat recovery device is supplied heat from a thermal oxidizer which utilizes vapors from one or more of the separated light ends, a reflux from a reflux drum, and the collected diesel fuel to generate heat via oxidation.

2. The process according to claim 1, wherein the process further comprises, prior to preheating of the additional waste motor oil by the heat recovery device, initially heating the additional waste motor oil to a first temperature by passing the additional waste motor oil through one or more heat exchangers which are supplied with heat from streams of one or more of the collected diesel fuel, a portion of liquid fraction withdrawn from and recirculated to the cracking vessel, and the first fuel oil withdrawn from the cracking vessel, wherein the additional waste motor oil heated to the first temperature is subsequently heated by the heat recovery device to at least the cracking temperature.

3. The process according to claim 1, wherein the first temperature is about 500° F.

4. The process according to claim 1, wherein the vaporized fraction of hydrocarbons enters the distillation column directly from the cracking vessel.

5. The process according to claim 1, wherein the cracking temperature ranges from 625° F. to 700° F.

6. A process according to claim 1, wherein the collected diesel fuel comprises a No. 2 diesel fuel.

7. The process according to claim 1, wherein the process further comprises feeding a portion of the collected diesel fuel to a reflux drum and providing a reflux to the top of the distillation column from the reflux drum.

8. The process according to claim 7, wherein a reflux ratio ranges from 0.7 to 1:1.

9. The process according to claim 1, wherein the unprocessed waste motor oil contains 2 to 7% water.

10. The process according to claim 1, wherein the unprocessed waste motor oil comprises an unfiltered mixture of water and used motor oil.

11. The process according to claim 1, wherein the process further comprises blending the first fuel oil with a No. 6 fuel oil to obtain a No. 5 fuel oil.

12. process according to claim 1, wherein the first fuel oil is withdrawn at a rate of 25% in relation to the amount of additional waste motor oil introduced into the cracking vessel.

13. A continuous process for cracking unprocessed waste motor oil into a plurality of fuel oils comprising:

thermally cracking the unprocessed waste motor oil in a cracking vessel at a cracking temperature ranging from about 625° F. to 700° F. to yield a vaporized fraction of cracked hydrocarbons and a liquid fraction of a fuel oil other than diesel;

distilling the vaporized fraction of cracked hydrocarbons to separate out light ends, thereby yielding a remaining portion of the vaporized fraction of cracked hydrocarbons comprising a diesel fuel;

withdrawing a portion of the liquid fraction from the cracking vessel, combining the withdrawn portion of the liquid fraction with additional waste motor oil to obtain a combined stream of additional waste motor oil, supplying the combined stream to a heat recovery device with a circulation pump, and subsequently introducing the combined stream, preheated to at least the cracking temperature, into the cracking vessel;

continuously withdrawing the fuel oil other than diesel from the cracking vessel while continuously introducing the combined stream of additional waste motor oil preheated to the cracking temperature into the cracking vessel with the circulation pump to maintain a volume in the cracking vessel, wherein a cracking temperature in the cracking vessel is maintained by the preheated combined stream of additional waste motor oil;

wherein the heat recovery device heats the combined stream of additional waste motor oil to at least the cracking temperature with heat generated by oxidation of vapors of the separated light ends in a thermal oxidizer.

14. A process of converting used motor oil into a No. 5 fuel oil and No. 2 diesel fuel without fouling of the process equipment, comprising:

heating a quantity of unfiltered used motor oil, carrying a suspension of metal particles, at ambient pressure to a cracking temperature in a cracking vessel;

withdrawing a first cracked oil from said cracking vessel, said first cracked oil comprising a non-diesel fuel oil carrying a suspension of metal particles upon which solid production products have formed;

withdrawing a portion of liquid from the cracking vessel;

combining the withdrawn portion of the liquid with additional used motor oil containing suspended metal particles to obtain a combined stream of additional used motor oil containing suspended metal particles:

supplying the combined stream of additional used motor oil containing suspended metal particles to a heat recover device with a circulation pump;

preheating the combined stream of additional used motor oil containing suspended metal particles to at least the cracking temperature with a heat recovery device;

maintaining a fixed volume of used motor oil inside the cracking vessel by continuously introducing the combined stream of preheated additional used motor oil containing suspended metal particles into the cracking vessel such that the cracking temperature is maintained in the cracking vessel through such continuous introduction of the combined stream of preheated additional used motor oil;

separating a vaporized fraction of cracked hydrocarbons in a distillation column, wherein the vaporized fraction of hydrocarbons enters the distillation column directly upon exiting the cracking vessel;

separating light ends from the vaporized fraction, a remaining portion of the vaporized fraction comprising the No. 2 diesel fuel;

supplying the light ends to a thermal oxidizer which supplies heat to the heat recovery device by oxidizing vapors of the light ends;

blending the first cracked oil withdrawn from the cracking vessel with a No. 6 bunker oil to obtain the No. 5 fuel oil; and filtering the No. 5 fuel oil to remove the solid production products.

15. The process according to claim 14, wherein the process further comprises, prior to preheating the additional used motor oil, initially raising the temperature of the additional used motor oil to about 500° F. by passing the additional used motor oil through a plurality of heat exchangers.

16. The process according to claim 15, wherein the process further comprises supplying a portion of the No. 2 diesel fuel to a reflux drum and providing a reflux to the distillation column from the reflux drum.

* * * * *

UNITED STATES PATENT AND TRADEMARK OFFICE

CERTIFICATE OF CORRECTION

PATENT NO. : 5,885,444
DATED : March 23, 1999
INVENTOR(S) : Wansbrough et al.

It is certified that error appears in the above-identified patent and that said Letters Patent is hereby corrected as shown below:

Column 5,
Lines 9 and 10, should read -- The thermal oxidizer 30 is available from its designer, Thermatrix, Inc., of San --

Signed and Sealed this

Thirtieth Day of December, 2003

JAMES E. ROGAN
*Director of the United States Patent and Trademark Office*